US005458159A

United States Patent [19]

Kilmer

[11] Patent Number: 5,458,159

[45] Date of Patent: Oct. 17, 1995

[54] SHIELDED ELECTRICALLY POWERED WIRE WRAP TOOL

[75] Inventor: Paul R. Kilmer, Cheraw, S.C.

[73] Assignee: Cooper Industries, Inc., Houston, Tex.

[21] Appl. No.: 169,511

[22] Filed: Dec. 17, 1993

[51] Int. Cl.[6] ..... B21F 15/04

[52] U.S. Cl. ..... 140/122; 310/50

[58] Field of Search ..... 310/50; 140/122, 140/124

[56] References Cited

U.S. PATENT DOCUMENTS

| | | | |
|---|---|---|---|
| 3,699,366 | 10/1972 | Wood | 310/50 |
| 4,175,247 | 11/1979 | Klemm | 310/50 |
| 4,380,111 | 4/1983 | Galloup et al. | 140/124 |
| 4,638,196 | 1/1987 | Kranzler | 310/50 |

OTHER PUBLICATIONS

The Cooper Group; *The New Wire–Wrap®R3;4/87*; Apex NC; (2 pp.).

Cooper Tools; *Introducing the New Wire–Wrap®X4A Fatigue Reduction Program;* Copyright 1992, Cooper Industries; Apex, NC; (2 pp.).

*Primary Examiner*—Lowell A. Larson

*Attorney, Agent, or Firm*—Conley, Rose & Tayon

[57] ABSTRACT

An improved wire wrap tool having a motor, a power supply and a power circuit, the improvement comprising means for shielding the motor in a manner that prevents the tool from emitting undesired amounts of electromagnetic interference and means for damping transient voltage spikes in the power circuit.

20 Claims, 5 Drawing Sheets

SHIELDED ELECTRICALLY POWERED WIRE WRAP TOOL

TECHNICAL FIELD OF THE INVENTION

The present invention relates to a tool for creating a wrapped wire electrical connection. More particularly, the present invention relates to an electrically powered tool for wrapping a wire around the post, said tool being shielded to prevent transmission of electromagnetic interference from the tool to nearby electrical equipment and components.

BACKGROUND OF THE INVENTION

In the assembly of devices such as printed circuit boards, it is common to make electrical connections in situ. Such connections are often made by means of soldering, but may also be made by means of wire wrapping. Wire wrapping entails passing one end of a wire several times closely and tightly around a post, such that a good electrical connection is made. If the wire is insulated, a section of insulation adjacent the wire end must be removed to allow electrical contact. Power tools have been developed to complete wire-wrapped connections in a quick and consistent manner. Such tools are commonly referred to as wire-wrap tools. One type of wire-wrap tool resembles an electric drill and includes a driving end comprising a collet, which receives a bit having two apertures therein. One of the apertures is centered on the axis of the bit while the other is offset radially from the axis. To operate such a tool, the wire end to be connected is threaded into the offset aperture and the center aperture is then placed over the post to which the wire is to be connected. When the tool is operated, the bit spins, causing the wire to be wrapped tightly around the post. The wire is drawn outwardly through the bit as it wraps around the post until the wire end is completely wrapped.

Heretofore, it was common for the individual components of the materials being worked, such as printed circuit boards, to be themselves shielded or protected from electromagnetic interference. Cost considerations, however, have recently led to the creation of several such circuits that lack adequate shielding of their individual components. Such circuit boards may be enclosed in a shield which protect the entire board, but such shielding is inadequate when it becomes necessary to directly access individual components the board, such as in the instance of repairs or alterations. In those instances, the electromagnetic interference generated by the power tools used to perform the repairs, such as wire wrap tools, can cause damage or interruptions to the system in which the board is integrated. Hence, it is desired to provide a tool for completing wire wrap connections that does not produce significant electromagnetic interference (EMI) or radio frequency interference (RFI). As RFI is that portion of EMI in the radio frequency range, references to EMI hereinafter shall mean both EMI and RFI.

SUMMARY OF THE INVENTION

The present invention comprises an improved wire wrap tool wherein the improvement includes modifications of the tool to provide electromagnetic shielding of the tool and protection of electronic circuit components. If the tool is a battery-powered tool, shielding can be accomplished by wrapping at least the brushing end of the motor with metal foil or the like, shielding the motor with an integral varistor, and including at least one capacitor in the motor drive circuit.

If the tool is an AC-powered tool, generated EMI is much greater and adequate shielding requires several elements. Namely, it has been found that optimal shielding can be obtained using a metal-encased DC motor, including a zero-voltage crossover switch in the power circuit, damping any start-up voltage spike, encasing the tool in a shielded housing, and providing a shielded power cord to the tool.

BRIEF DESCRIPTION OF THE DRAWINGS

For a detailed description of a preferred embodiment of the invention reference will now be made to the accompanying drawings wherein.

DETAILED DESCRIPTION OF THE INVENTION

Figure 1:
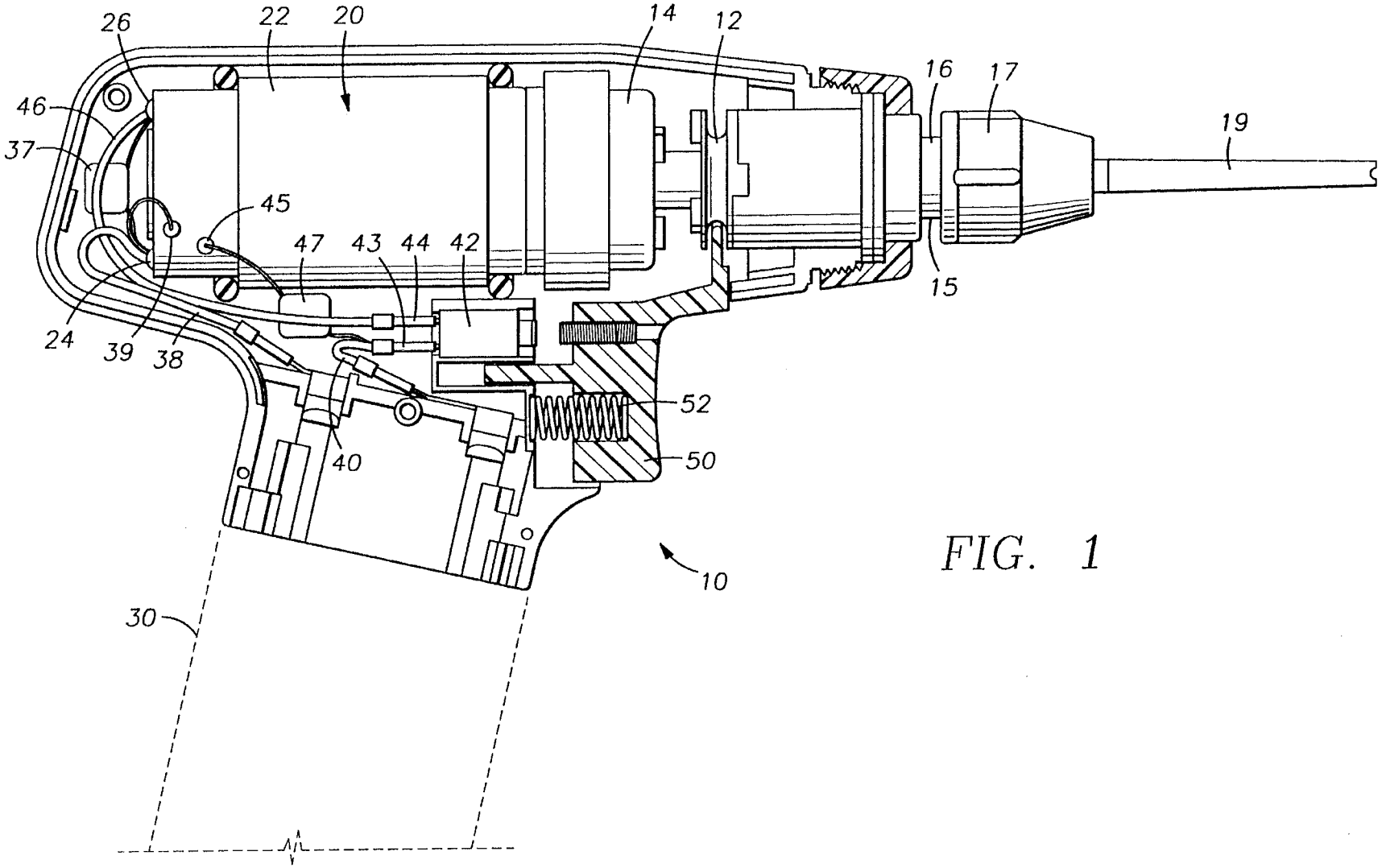
FIG. 1 is an elevation, partially in cross-section, of a wire-wrap tool constructed in accordance with the present invention.
Figure 2:
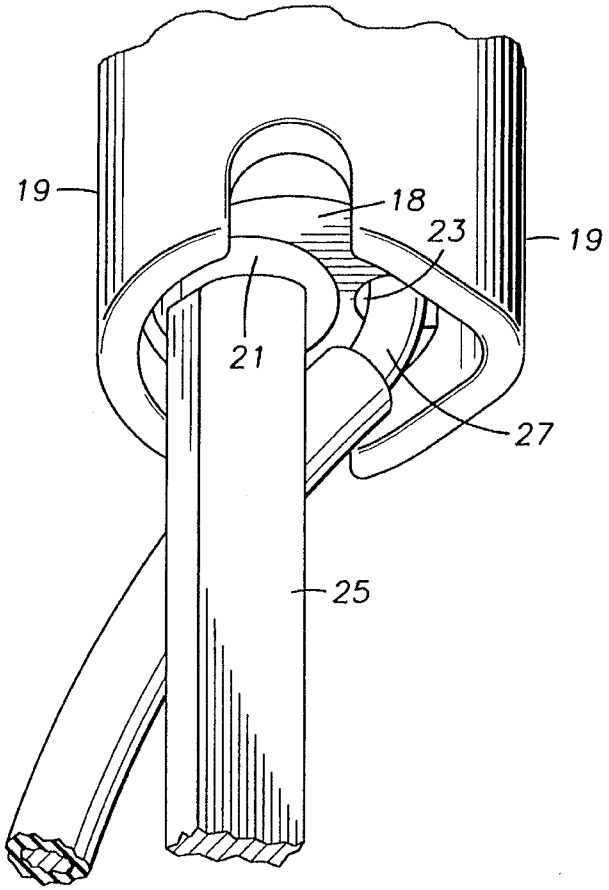
FIG. 2 shows the bit end of a wire-wrap tool as it is used to create a wire-wrapped connection.
Figure 5:
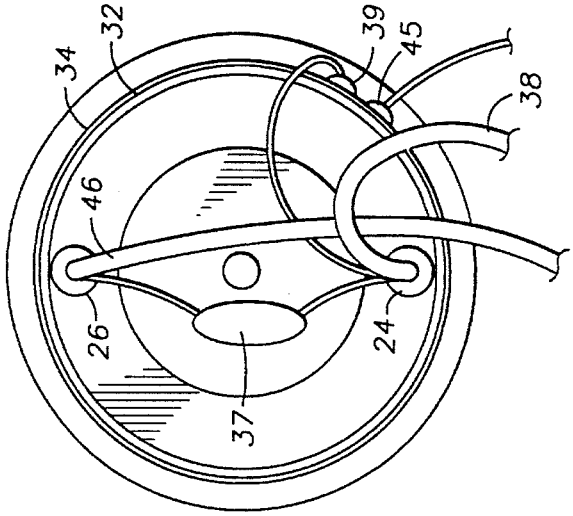
FIG. 5 is an end elevation of the motor of FIG. 4.

Referring initially to FIGS. 1 and 2, the overall assembly of a shielded wire wrap tool 10 is shown. Tool 10 includes a clutch assembly 12, a drive assembly 14, a collet assembly 16, a motor 20 and power source 30. Collet assembly 16 includes a collet 15, a collet nut 17, a bit 18 and a sleeve 19. Bit 18 is held in place by sleeve 19 and extends through collet 15. As shown in FIG. 2, bit 18 includes a center opening, in which the post 25 to be wire-wrapped is received, and an offset opening 23, into which the wire end 27 is inserted. These elements of tool 10 are standard and are well-known in the art. Rotational driving force for the tool is provided by power source 30 and motor 20, the relevant portions of which are shown in greater detail in FIG. 4 and discussed below. Power source 30 may be either a DC source (battery) or a standard AC source.

Figure 3:
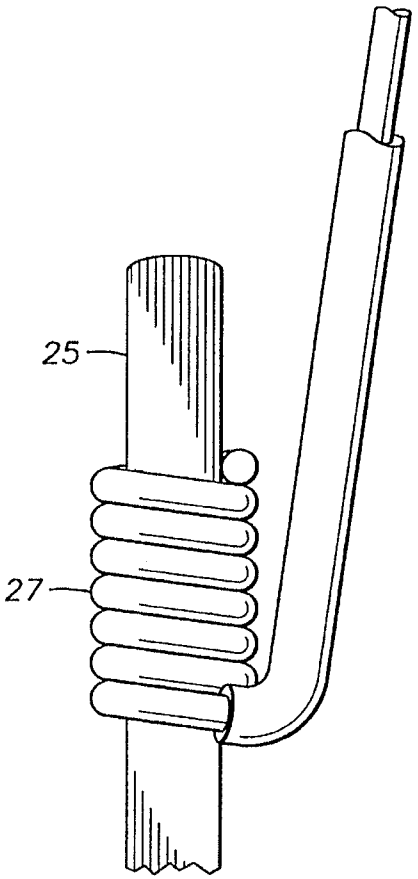
FIG. 3 is a completed wire-wrapped connection.

When the tool is operated, bit 18 rotates around post 25 and inside sleeve 19, and wire end 27 is drawn out of opening 23 until it is completely wrapped around post 25. This operation creates a snug, wire-wrapped connection like that shown in FIG. 3. A conventional wire-wrap tool, however, creates significant EMI in the course of each wire-wrapping operation, which can have adverse effects on nearby electronic systems. The present invention comprises a wire-wrap tool that has been modified to produce less than harmful amounts of EMI.

Embodiments of the shielded tool of the present invention are provided herein for both battery-powered and AC powered tools. The latter will be hereinafter referred to as "electric", in accordance with industry custom.

Battery-Powered Tool

Figure 6:
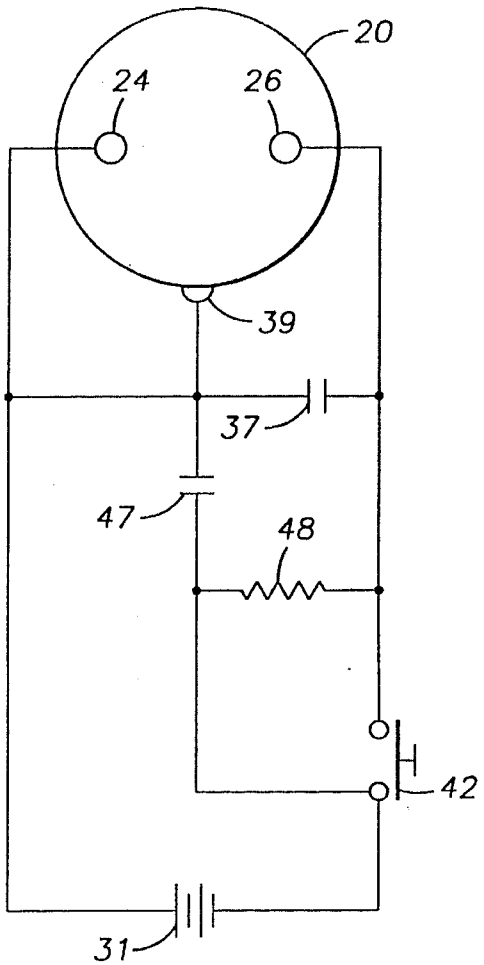
FIG. 6 is a schematic illustration of a shielded wire-wrap tool circuit constructed in accordance with a preferred embodiment.
Figure 4:
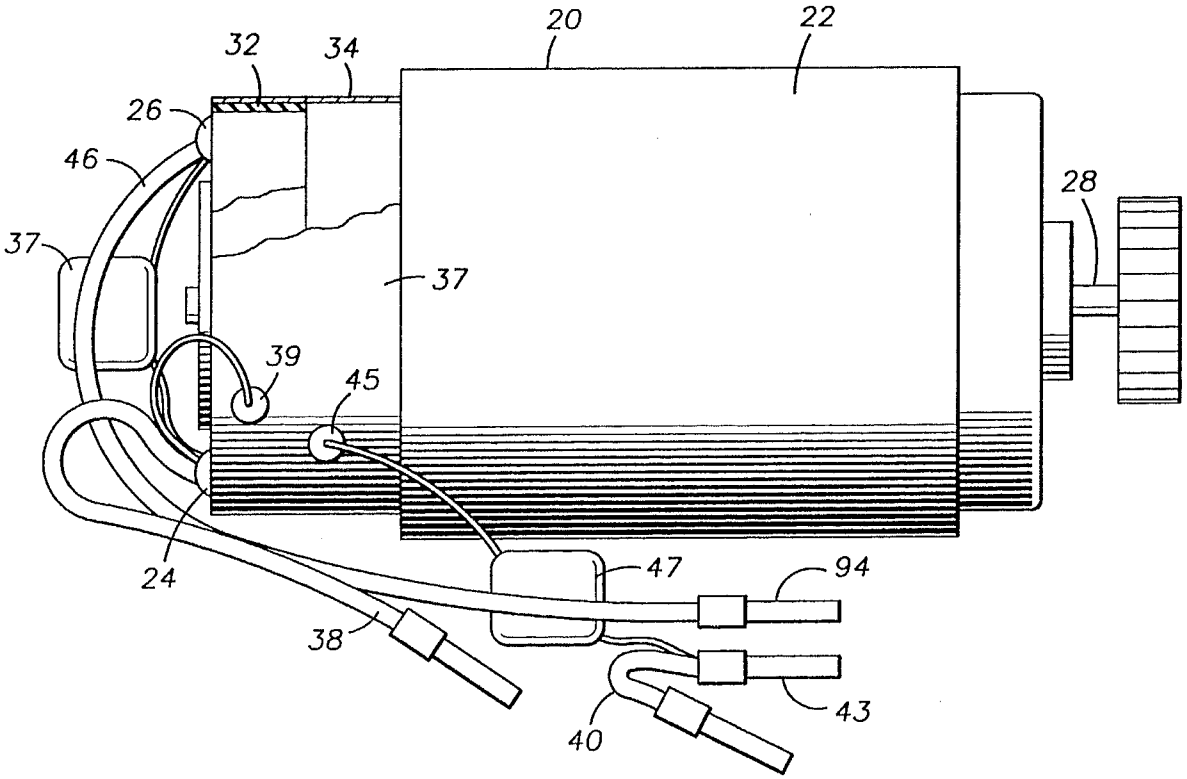
FIG. 4 is a detailed view of the motor of the tool shown in FIG. 1, partially in cross-section.

Referring now to FIGS. 1, 4 and 6, in a battery-powered wire-wrap tool, power source 30 is a battery 31 (shown in FIG. 6). Motor 20 is a DC motor and includes a motor body 22 preferably including a negative ground terminal 24 and positive terminal 26 extending from one end and a coaxial drive shaft 28 extending opposite terminals 24, 26, for driving the bit assembly. Motor 20 may be equipped with lead wires instead of terminals, or otherwise modified, without departing from the spirit of the invention. Typically, most of motor body 22 is encased in a metallic housing that provides adequate electromagnetic shielding. The terminal end, however, comprises a plastic end cap (not shown), which in turn supports the exposed terminals 24, 26. This portion of motor 20 encloses the motor brushes, which produce and emit undesired EMI and/or RFI.

According to the preferred embodiment of the present invention, an insulating layer 32 is first wrapped around the terminal (brush) end of motor body 22. Insulating layer 32 preferably comprises a polyester tape having an adhesive backing. Insulating layer 32 extends from the edge of the opening in the brush end of the motor to the edge of the plastic motor end cap. An example of a suitable insulating tape is Scotch Type 46 made by 3M Company of Minneapolis, Minn. Insulating layer 32 is in turn wrapped in a shielding layer 34, which preferably covers at least both insulating layer 32 and the plastic end cap of the motor. Shielding layer 34 is preferably a metallic tape with an adhesive backing and is more preferably a tin coated copper foil tape such as that manufactured by the 3M Company of Minneapolis, Minn. and sold as Type 1345. It will be understood that shielding layer 34 may comprise any suitable material capable of blocking the transmission of EMI, including metal-containing composites. Shielding layer 34 forms a electromagnetic shield around the electrical components of motor 20, reducing the emission of EMI therefrom, while insulating layer 32 prevents an electrical short from developing between shielding layer 34 and the motor brushes. While the preferred shielding is disclosed herein to be a full layer of metal foil, it will be understood by those skilled in the art that other shield configurations, such as metal strips or a metal cap, may be substituted for the foil, as long as an adequate shield results from such substitution.

To further reduce the emission of EMI, it is preferred that motor 20 include an integral varistor "ring" (not shown) encircling the commutator. The resistance of the varistor ring drops rapidly as the voltage increases beyond a certain level. By becoming increasingly conductive at high voltage, the varistor ring provides a shunt to ground to protect the circuit against transient high voltage spikes. Motors equipped with such varistor rings are commercially available.

In addition to the foregoing elements that reduce emission of EMI from motor 20, the power circuit of the tool includes several damping or capacitive components that serve to damp voltage spikes in the circuit. A schematic of the preferred circuit including these elements is shown in FIG. 6.

Referring now to FIGS. 1, 4, 5 and 6, the wire wrap tool constructed in accordance with the preferred embodiment includes power source 30, a capacitor 37, a switch 42, a second capacitor 47 and a resistor 48. Capacitor 37 connects terminals 24, 26 of motor 20. In addition, one of the leads of capacitor 37 extends beyond motor terminal 24 and is grounded on shielding layer 34 at 39.

Referring now to FIGS. 1 and 6, battery 31 connects to two insulated conductors 38, 40. Conductor 38 connects battery 31 to terminal 24 of motor 20, and therefore also to ground at 39. Conductor 40 connects to one terminal 43 of switch 42. A second capacitor 47 connects between terminal 43 and ground at 45. The other terminal 44 of switch 42 connects via conductor 46 to motor terminal 26. As shown in FIG. 6, the preferred circuit also includes a resistor 48 electrically connected between the switch terminals 43 and 44. Preferably resistor 48 has a fairly high value. It will be understood from the foregoing that when switch 42 is closed, power flows from battery 31 through motor 20.

As shown in FIG. 1, in the preferred embodiment a spring-loaded trigger 50 is incorporated in tool 10 such that depression of the trigger results in closing of switch 42. Because a spring 52 biases trigger 50 away from switch 42, trigger 50 will release switch 42 when pressure on trigger 50 is removed and the circuit will open.

The purpose of capacitors 37, 47 is to remove any spikes in voltage that might occur in the circuit. Such spikes particularly occur at start-up, when trigger 50 is initially depressed. Likewise, resistor 48 keeps the complete circuit at the same potential level when the tool is not in use and helps prevent a turn-on spike that might otherwise occur when trigger 50 is depressed.

It has been found that the foregoing components, if used separately, will not reduce EMI emission to a level low enough to avoid damage or interruptions to the circuit. When taken together, however, they reduce emitted EMI by approximately 90 percent or more when compared to the emitted EMI of a conventional (unshielded) wire-wrap tool, thereby making the shielded tool suitable for use on unprotected circuits or circuits that are vulnerable to interference.

Electric Tool

Figure 7:
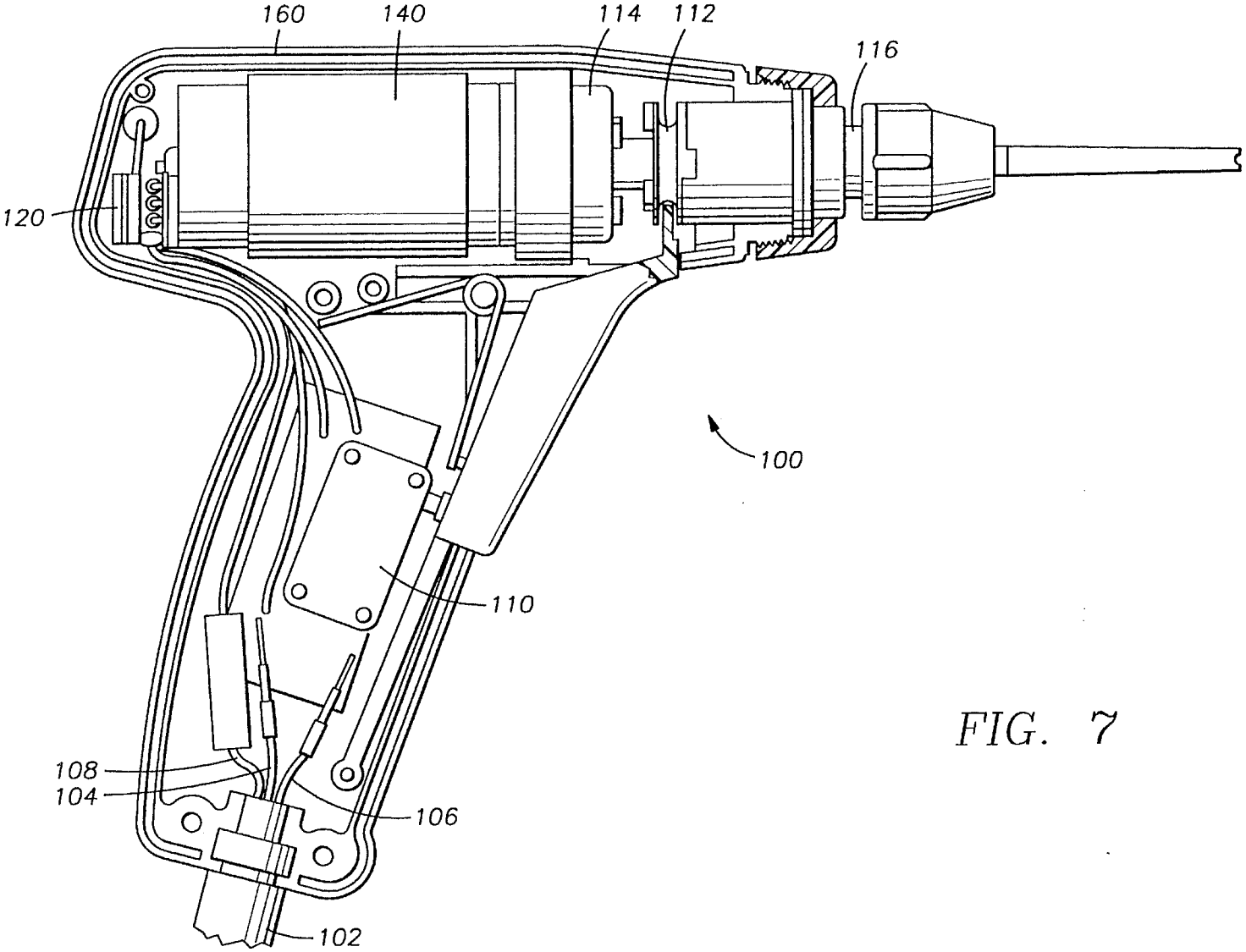
FIG. 7 is an elevation, partially in cross-section, of a second embodiment of a shielded wire-wrap tool.
Figure 8:
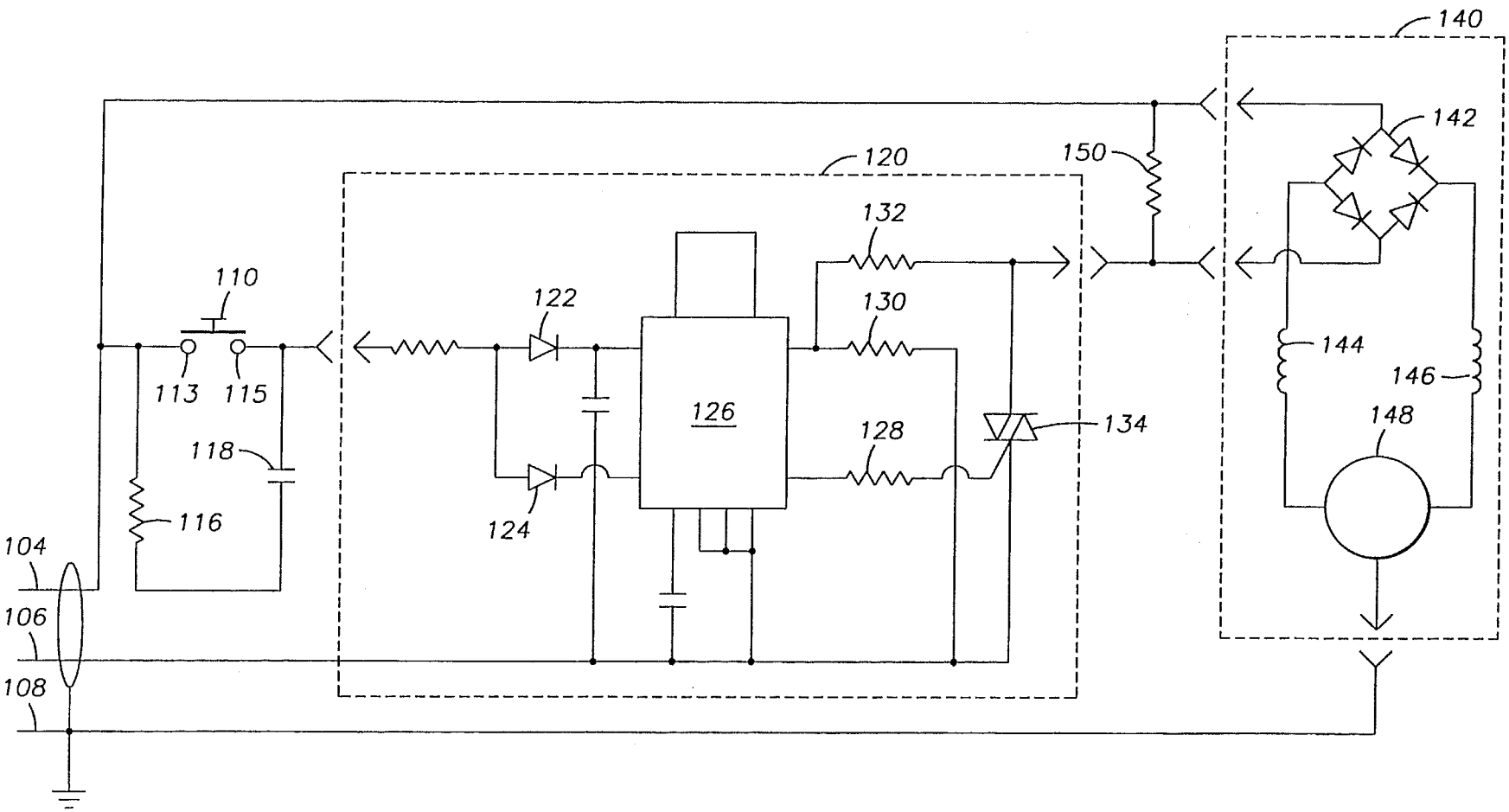
FIG. 8 is a schematic illustration of a shielded wire-wrap tool circuit constructed in accordance with a second embodiment.

Referring now to FIGS. 7 and 8, a second embodiment of the shielded wire-wrap tool is shown. This embodiment is powered by a standard AC power source, such as 120 V, 60 Hz current. It has been found that an AC powered wire-wrap tool generates much more EMI than the DC tool discussed above, both because of its higher voltage and its cyclic nature. For this reason, it is more difficult to achieve adequate damping of the EMI in the electric tool. Therefore, several additional damping components have been found to be necessary to provision of an acceptably shielded electric tool.

The preferred electric wire-wrap tool 100 includes a trigger switch 110, a zero-voltage cross-over switch 120, and a motor assembly 140. The clutch, drive, and bit assemblies 112, 114, 116 of the electric tool are substantially the same as those of the battery-powered tool. Power is preferably transmitted to the electric tool via a three-wire cord set 102, which includes two conductors 104, 106 and a ground wire 108. According to the preferred embodiment, cord set 102 includes conventional cord shielding means (not shown), to reduce EMI emitted by the conductors. Conductor 106 connects directly to the power input of zero-voltage cross-over switch 120.

Still referring to FIGS. 7 and 8, trigger switch 110 includes a pair of contacts 113, 115. Conductor 104 connects to contact 113 and also to one terminal of motor assembly 140, while contact 115 connects to the control input of zero-voltage cross-over switch 120. The output of zero-voltage cross-over switch 120 connects to the second terminal of motor assembly 140. A high-value resistor 116 and a low value capacitor 118 are connected in series across contacts 113, 115, in order to damp out start-up spikes. In assembly of the tool, it has been found preferable to attach resistor 116 and capacitor 118 as closely as possible to the circuit board, as longer lead wires to these components tend to act as mini-antennae and emit more EMI.

Zero-voltage cross-over switch 120 may be constructed by any conventional means. According to the preferred embodiment shown in FIG. 8, zero-voltage cross-over switch 120 includes a pair of diodes 122, 124, a zero-voltage cross-over chip 126, at least three resistors 128, 130 and 132, and a bidirectional triode thyristor (triac) 134. As will be understood, zero-voltage cross-over chip 126 controls triac 134, triggering it at the beginning of each reversal of current in the alternating current cycle. Because triac 134 is connected between conductor 106 of the power supply and the second terminal of motor assembly 140, triggering of triac 134 results in the flow of current to motor assembly 140. Inclusion of zero-voltage cross-over switch 120 in the circuit reduces both the turn-on and turn-off spikes and reduces the EMI and RFI emitted by the tool.

Still referring to FIG. 8, motor assembly 140 includes a full wave bridge rectifier 142, a pair of chokes 144, 146, and a DC motor 148. DC motor is preferably completely enclosed by a metal case, which serves as a shield to prevent emission of EMI and RFI from the motor. A DC motor is preferred over an AC motor in this application, as DC motors are smaller, achieve maximum rpm sooner, and have a higher start-up torque than AC motors in general. Thus, the power is converted to DC in rectifier 142. While it is not necessary to house rectifier 142 and chokes 144, 146 within the metal casing of motor assembly 140, it has been found that enclosing them therein helps to reduce emitted EMI.

It has further been found preferable to include a resistor 150 across the terminals of motor assembly 140, to increase the load on triac 134, to improve the turn-on characteristics, as otherwise the motor load would be too light for triac 134. Other components may be substituted for those described above, as will be understood by one skilled in the art.

Referring again to FIG. 7, the components of tool 100 are housed in a casing 160. Casing 160 is preferably a conventional, plastic casing, the inside of which has been coated with a metallic shielding composition. According to a preferred embodiment, the shielding composition comprises an acrylic-based, silver/copper composition suitable for spray application. An example of the preferred compound is Electrodag® 438, manufactured by Acheson Colloids Company of Port Huron, Mich. Other compounds, such as those containing silver, nickel, graphite and combinations thereof are equally effective, but are made less suitable by cost, environmental concerns and the like. An early attempt at providing the metal shielding coating on the outside of the tool was unsuccessful in achieving a reduction in emitted EMI, so it is currently preferred to apply the coating to the inside of the tool casing. While the preferred shielding is disclosed herein to be a full coating of metallic material, it will be understood by those skilled in the art that other shield configurations, such as metal strips, may be substituted for the coating, as long as an adequate shield results from such substitution.

Taken together, these additions to the tool reduce the EMI emission measurements from a peak-to-peak (P-P) voltage of approximately 47 V for a poor quality, unshielded tool or 27 V for a better quality, unshielded tool, to approximately 1.2 V for a shielded tool. Without the zero-voltage cross-over switch, the EMI of the tool could not be reduced below 5 V. In addition, it was found that adding a shielded cord set reduced the P—P voltage still further, to approximately 300–400 mV.

While two preferred embodiments of the invention have been shown and described, modifications thereof can be made by one skilled in the art without departing from the spirit of the invention. For example, substitution of known damping or shielding components for other components or groups of components, or of one motor type for another, may be made without departing from the spirit of the invention.

What is claimed is:

1. A wire wrap tool having a motor, a power supply and a power circuit, comprising:

a shield for shielding the motor in a manner that prevents the tool from emitting undesired amounts of electromagnetic interference; and at least one damping component for damping transient voltage spikes in the power circuit.

2. The wire wrap tool according to claim 1 wherein said shield comprises a layer of metallic foil surrounding a portion of the motor and grounded.

3. The wire wrap tool according to claim 2, further including an insulating layer between a least a portion of the motor and said foil layer.

4. The wire wrap tool according to claim 1 wherein said shield comprises a layer of a metal-containing composite surrounding a portion of the motor and grounded.

5. The wire wrap tool according to claim 1 wherein said shield comprises an integral varistor ring in the motor.

6. The wire wrap tool according to claim 1 wherein the power circuit includes a switch having a pair of contacts and said damping component comprises a first capacitor connecting one of said contacts to ground.

7. The wire wrap tool according to claim 1 wherein said damping component comprises a second capacitor connected across the terminals of the motor.

8. The wire wrap tool according to claim 7 wherein one lead of said second capacitor is grounded.

9. The wire wrap tool according to claim 1 wherein the power circuit includes a switch having a pair of contacts and said damping component comprises a first capacitor connecting one of said contacts to ground and a second capacitor connected across the terminals of the motor.

10. The wire wrap tool according to claim 1 wherein said tool is housed in a casing and said shield comprises a layer of metal material on said casing.

11. The wire wrap tool according to claim 10 wherein said material layer covers the inside surface of said casing.

12. The wire wrap tool according to claim 10 wherein said material is an acrylic-based silver/copper blend.

13. The wire wrap tool according to claim 1 wherein the power supply is a standard alternating current and said damping component comprises a zero-voltage crossover switch between the power source and the motor.

14. The wire wrap tool according to claim 13 wherein said zero-voltage crossover switch includes a triac.

15. The wire wrap tool according to claim 14, further including a trigger switch including a capacitor and resistor connected in series thereacross.

16. The wire wrap tool according to claim 13, further including an electromagnetically shielded cord for supplying said alternating current.

17. The wire wrap tool according to claim 16 wherein said cord includes a ground wire connected to the motor.

18. A battery powered wire wrap tool capable of operating without emitting undesirably high levels of electromagnetic interference, comprising:

a wire wrapping means comprising a clutch, a drive and a bit;

a motor housed in a casing and having a pair of terminals, said motor driving said wire wrapping means;

an electromagnetically shielding layer wrapped around at least a portion of said motor;

a first grounded capacitor connected across the terminals of said motor; and a power circuit including a switch, a resistor connected across said switch, and a second grounded capacitor connected to said switch, said circuit including the battery.

19. An AC-powered wire wrap tool capable of operating without emitting undesirably high levels of electromagnetic interference, comprising:

a wire wrapping means comprising a clutch, a drive and a bit;

a cord for transmission of alternating current to the tool, said cord including first and second conductors and a ground wire;

a DC motor enclosed in a metal housing, said motor having first and second terminals or lead wires, said housing connected to said ground wire;

a power circuit connected between said first and second conductors and said first and second terminals, said circuit including a trigger switch, a zero-voltage cross-over switch including a triac, and a capacitor and resistor connected in series across said zero-voltage cross-over switch; and a tool casing adapted for receiving said wire wrap means, said motor and said circuit, said casing being lined with a layer of electromagnetically shielding material.

20. The AC-powered tool according to claim 19 wherein said cord includes an electromagnetic shielding layer.

* * * * *